US005660100A

United States Patent [19]

Spelten et al.

[11] Patent Number: 5,660,100

[45] Date of Patent: Aug. 26, 1997

[54] APPARATUS FOR THE STERILIZATION DURING FILLING OF PREFERABLY LIQUID FOODSTUFFS INTO PACKAGING CONTAINERS

[75] Inventors: Franz-Willi Spelten, Wegberg; Dirk Auer, Meerbusch, both of Germany

[73] Assignee: PKL Verpackungssysteme GmbH, Linnich, Germany

[21] Appl. No.: 599,258

[22] Filed: Feb. 9, 1996

[30] Foreign Application Priority Data

Feb. 11, 1995 [DE] Germany ..... 195 04 558.0

[51] Int. Cl.[6] ..... A23L 3/00; B65B 55/00; B65D 5/00

[52] U.S. Cl. ..... 99/356; 99/361; 99/367; 99/370; 99/470; 99/483; 99/516

[58] Field of Search ..... 99/359–371, 477–479, 99/483, 470, 353–356, 330, 516; 422/26, 28, 300–304

[56] References Cited

U.S. PATENT DOCUMENTS 4,155,293 5/1979 Spiel et al. ..... 99/352

4,342,726 8/1982 Savi ..... 422/302

4,776,267 10/1988 Harris ..... 99/477 X

FOREIGN PATENT DOCUMENTS 237777 9/1987 European Pat. Off. ..... B65B 55/02

*Primary Examiner*—Timothy F. Simone

*Attorney, Agent, or Firm*—Standley & Gilcrest

[57] ABSTRACT

The invention relates to an apparatus for the sterilization during the filling of preferably liquid foodstuffs into packaging containers, having a preheating zone (A), a sterilizing zone (B), a drying zone (C), a filling zone (D) and a closure zone (E), in that the period during which the individual zones are acted upon with a sterilizing agent can be shortend and that the quantity of the sterilizing agent to be used can be minimized. In addition, a simple construction is desirable, so that the expenditure always required for cleaning and maintenance is also minimized. This is solved by the features that the individual zones (A, B, C, D, E) are combined into an overall space and closed in the upward direction by a single hood into which the required supply elements and lines (2, 3, 4, 5) are integrated.

9 Claims, 2 Drawing Sheets

APPARATUS FOR THE STERILIZATION DURING FILLING OF PREFERABLY LIQUID FOODSTUFFS INTO PACKAGING CONTAINERS

BACKGROUND OF THE INVENTION

The invention relates to an apparatus for the sterilization during the filling of preferably liquid foodstuffs into packaging containers, having a preheating zone, a sterilizing zone, a drying zone, a filling zone and a closure zone.

For technical reasons of hygiene and keeping properties, special attention must always be given to sterilization when more particularly liquid foodstuffs are filled into packaging containers. The actual sterilization is performed by known processes, in which the surfaces of the packagings which are to be sterilized must come into contact for a predetermined period of time with a sterilizing agent which must then—i.e., prior to the actual filling operation—be again removed from the surface of the packaging (DE 30 36 972 C2).

To make the sterilizing operation as economical as possible, the changeover has been made to the use of $H_2O_2$—i.e., hydrogen peroxide—as the sterilizing agent. An optimum effect is achieved if the packagings to be filled are heated in a first zone (preheating zone), to enable the subsequent treatment to be performed as quickly and efficiently as possible. The packages continuously move forwards and are conveyed from the preheating zone into the following sterilizing zone, in which they are wetted with the sterilizing agent, preferably $H_2O_2$. To this end the liquid $H_2O_2$ is atomized by means of hot compressed air or superheated steam to give an $H_2O_2$ aerosol, so that no larger and heavier droplets can be deposited on the surface of the packaging which might no longer be removable during the following rinsing operation. It has been found that the brief wetting with the $H_2O_2$ aerosol in a hot atmosphere is adequate for the reliable extermination of any bacteria present. For the removal of the $H_2O_2$ aerosol from the packagings, the packagings then pass through a further zone, the so-called drying zone, in which the packagings are flushed at atmospheric pressure with flowing superheated steam. The packagings are then filled, also using known means, in a filling zone.

Since sterile conditions must be present in all the aforementioned five zones, the individual zones are substantially partitioned-off from the exterior, to enable the packagings to be conveyed inside a germicidal atmosphere. Although the use of $H_2O_2$ has proved satisfactory for sterilization, with the filling machines used care must be taken that none of the $H_2O_2$ atmosphere gets into the room in which the filling machine is situated, for economic and also health reasons (hydrogen peroxide is a strong oxidant).

Moreover, particularly before the start of the shift, each individual zone must first be flushed with a quantity of $H_2O_2$ aerosol such as will reliably sterilize or remove any contaminated air which may be present. For this purpose hitherto in order to achieve the required sterilization, it was necessary to flush out the $H_2O_2$ vapour in the individual chambers of the different zones for a particular period of time. This called for an expensive construction and a correspondingly heavy consumption of $H_2O_2$, since the individual chambers in the conveying direction of the packagings can never be really adequately sealed.

It is therefore an object of the invention so to design and further develop the aforementioned sterilization apparatus described in detail hereinbefore that the period during which the individual zones are acted upon with the sterilizing agent can be shortened and that the quantity of the sterilizing agent to be used can be minimized. In addition, a simple construction is desirable, so that the expenditure always required for cleaning and maintenance is also minimized.

SUMMARY OF THE INVENTION

This problem is solved according to the invention by the features that the individual zones are combined into an overall space and closed in the upward direction by a single hood into which the required supply elements and lines are integrated.

The apparatus according to the invention reduces not only the size of the filling machine used, but also the volume of the required base, since there is no longer any subdivision into individual chambers, but the individual zones are disposed inside a single sterile space. It has been found that the partitioning of the individual chambers for the different treatment processes is unnecessary, on condition that the sterilizing agent is suitably constructed for the adjustment of the required atmosphere. Optimum hermeticity of the sterile space of the filling machine can be achieved by a simple construction using a single hood.

According to a further feature of the invention, the hood consists substantially of an upper plate and a lower plate which are connected to one another and between which a cavity is formed. To obviate the risk of leakages at the places at which supply lines leave the upper plate or the lower plate, the upper and lower plates are welded to one another and preferably the cavity is hermetically sealed. A pressure test can therefore be applied to check the hermeticity of the hood during its production.

According to another idea of the invention, the cavity of the hood is filled with an insulating material; to this end it can be, for example, foamed. The use of such an insulating layer is more particularly advantageous to achieve an insulating effect, so that the sterilizing agent, condensed on a cool underside of the hood in the hot internal atmosphere in the sterile space can not get into the packages to be filled in the form of droplets.

More particularly conveniently the hood has substantially smooth surfaces, more particularly to reduce the cleaning expenditure regularly required.

According to a further feature of the invention the hood has a flange which extends all around and which is formed by a corresponding shaping of the plates used. This way an optimum seal can be obtained in the upper zone of the sterile space, which is more particularly "endangered" by the temperature level.

Lastly, according to another idea of the invention the hood has flanged connections for the connection of supply lines or the like, so that any supply lines can be readily released from the actual hood before the hood is removed.

DESCRIPTION OF THE PREFERRED EMBODIMENT

The invention will not be explained in greater detail with reference to the drawings, which illustrate only one embodiment thereof.

Figure 1:
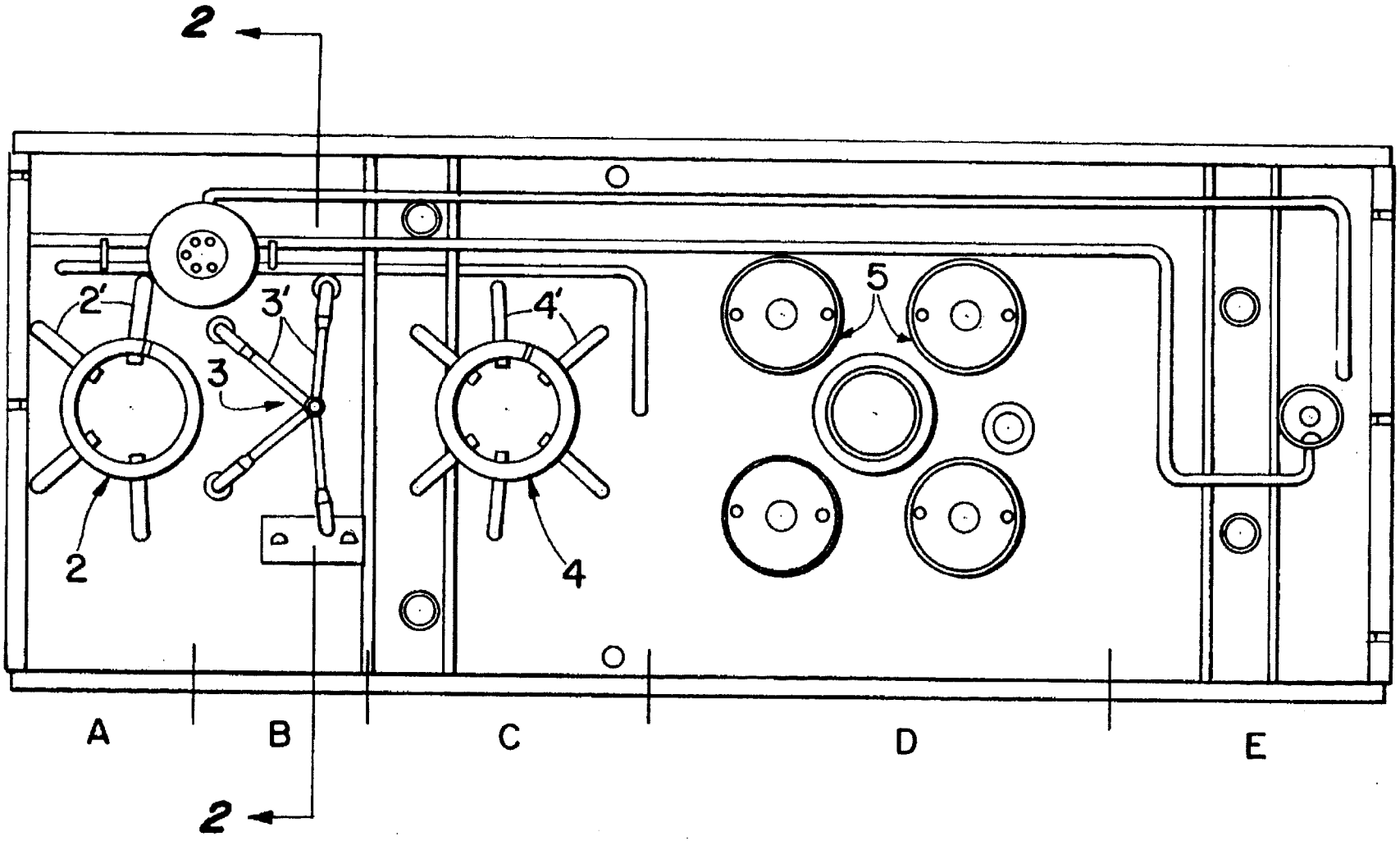
FIG. 1 a broken-open plan view of a hood of an apparatus according to the invention.

FIG. 1 shows in section a hood 1 of an apparatus according to the invention for the sterilization during the filling of preferably liquid foodstuffs into packaging containers. The drawing shows, successively from left to right, a preheating zone A, a sterilizing zone B, a drying zone C, a filling zone D and a closure zone E through which the packagings pass.

Since unlike the prior art, the apparatus according to the invention is not subdivided into individual chambers, the individual zones A, B, C, D, E are not separated from one another by partitions, but the sterilization space is bounded by a casing extending all around (not shown). In the upward direction the sterile space is bounded according to the invention by a hood 1 into which the required supply elements 2, 3, 4, 5 are integrated. These supply lines first include distributing elements 2 for the heating steam in the preheating zone. In the adjoining sterilization zone a sterilizing agent, preferably a $H_2O_2$ aerosol, is injected by a distributing element 3 via corresponding lines 3' into packagings 7 (merely outlined in FIG. 1). The packagings 7 are dried by a distributing element 4 and corresponding drying lines 4 in the drying zone C.

When the packagings 7, which in the preferred embodiment illustrated pass in two rows through the sterile space, have been sterilized and cleaned, they arrive at filling zone D, where they are filled by filling elements 5 (merely outlined). Finally, the packagings pass through the closure zone E, in which the upper zone of the packagings is kept sterile.

Figure 2:
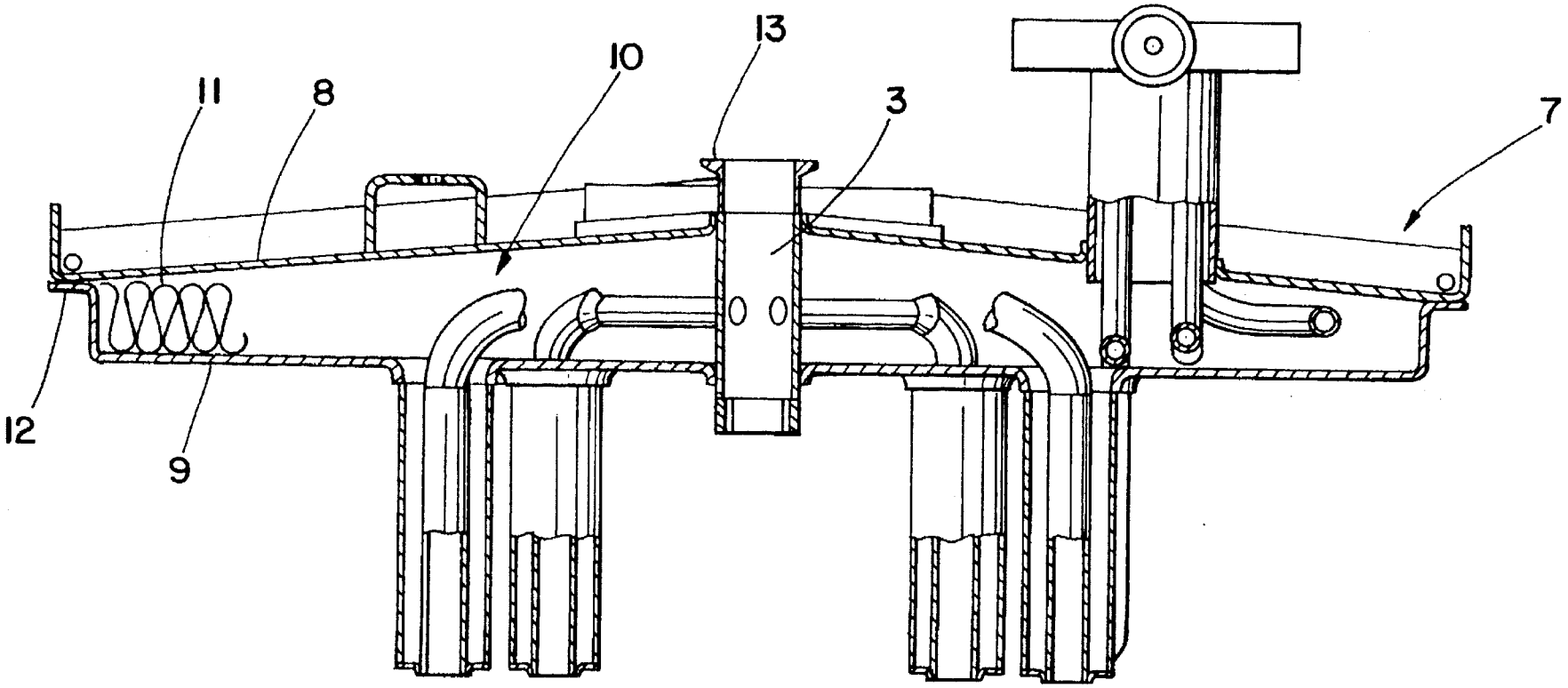
FIG. 2 is the hood shown in FIG. 1, vertically sectioned along the line II—II in FIG. 1.

The precise construction of the apparatus according to the invention is shown more particularly clearly in FIG. 2, which shows in section the hood 1 illustrated in FIG. 1 in the zone of the line II—II—i.e., the sterilizing zone B. As can be seen, the hood 1 consists substantially of an upper plate 8 and a lower plate 9 which are connected to one another and form a cavity 10. Since the upper and lower plates 8, 9 are welded to one another, a hermetically sealed cavity 10 can be formed, so that the hermeticity of the hood 1 can already be tested by subjecting the cavity 10 to pressure during the actual production of the hood 1.

FIG. 2 also shows how the cavity 10 of the hood 1 is filled with an insulating material 11, thus achieving a high degree of thermal insulation and reliably precluding any condensation of the sterilizing agent used on the underside of the hood 1 during the filling operation. To this end the cavity 10 of the hood 1 can be foamed with conventional insulating material 11.

FIG. 2 also shows how the hood 1 has a flange 12 which extends all around and which corresponds to the dimensions of the side walls (not shown) of the sterile space having the individual zones (A, B, C, D, E). Lastly, FIG. 2 also shows how the supply line (not shown) of the sterilizing agent is releasably connected to the hood 1 via a flange 13 having the distributing element 3.

We claim:

1. An apparatus for the sterilization of preferably liquid foodstuffs during filling into packaging containers, comprising a preheating zone, a sterilizing zone, a drying zone, a filling zone and a closure zone, wherein the zones are disposed directly adjacent to one another and not separated by partitions, and wherein the zones are covered by a single hood into which required supply elements and lines are integrated.

2. An apparatus according to claim 1, wherein the hood comprises an upper plate and a lower plate which are connected to one another and form a cavity.

3. An apparatus according to claim 2, wherein the upper and lower plates are welded to one another.

4. An apparatus according to claim 2, wherein the cavity of the hood is hermetically sealed.

5. An apparatus according to claim 2, wherein the cavity of the hood contains an insulating material.

6. An apparatus according to claim 5, wherein the insulating material is foamed.

7. An apparatus according to claim 1, wherein the hood has substantially smooth surfaces.

8. An apparatus according to claim 1, wherein the hood has a flange which extends all around the hood and which corresponds to the dimensions of a side wall of the hood.

9. An apparatus according to claim 1, wherein the hood has flanged connections for connection of supply lines.

* * * * *

UNITED STATES PATENT AND TRADEMARK OFFICE

CERTIFICATE OF CORRECTION

PATENT NO. : 5,660,100

DATED : August 26, 1997

INVENTOR(S) : Franz-Willi Spelten and Dirk Auer

It is certified that error appears in the above-identified patent and that said Letters Patent is hereby corrected as shown below:

In column 2, line 56, after "FIG. 1" please insert -- is --.

In column 2, line 62, please delete " not " and replace it with -- now --.

Signed and Sealed this

Sixteenth Day of December, 1997

*Attest:*

*Attesting Officer*

BRUCE LEHMAN

*Commissioner of Patents and Trademarks*